United States Patent [19]

Morelli

[11] Patent Number: 4,725,187

[45] **Date of Patent: * Feb. 16, 1988**

[54] EXCAVATOR

[76] Inventor: Aldo Morelli, 25 Rockwood Ter., Jamaica Plain, Mass. 02130

[ * ] Notice: The portion of the term of this patent subsequent to Jul. 7, 2004 has been disclaimed.

[21] Appl. No.: 855,328

[22] Filed: Apr. 24, 1986

[51] Int. Cl.[4] ..... E02F 5/02

[52] U.S. Cl. ..... 414/690; 414/694; 414/695.5; 414/718

[58] Field of Search ..... 414/728, 718, 715, 692, 414/691, 690, 688, 694, 695.5; 37/103

[56] References Cited

U.S. PATENT DOCUMENTS

| | | | |
|---|---|---|---|
| 3,002,638 | 10/1961 | Needy | 414/715 X |
| 3,129,831 | 4/1964 | Mrozek | 414/692 |
| 3,319,812 | 5/1967 | Waite | 414/694 |
| 3,445,015 | 5/1969 | Sampo et al. | 414/718 X |
| 4,142,308 | 3/1979 | Brandtjen | 414/718 X |
| 4,264,265 | 4/1981 | Stoychoff | 414/718 |
| 4,266,908 | 5/1981 | Leiker | 414/728 X |
| 4,274,797 | 6/1981 | Coon | 414/718 X |
| 4,306,832 | 12/1981 | Schmiesing | 414/728 X |
| 4,553,899 | 11/1985 | Magni | 414/728 X |
| 4,677,772 | 7/1987 | Morelli | 414/718 X |

FOREIGN PATENT DOCUMENTS

| | | | |
|---|---|---|---|
| 640860 | 5/1962 | Canada | 414/690 |
| 651299 | 6/1963 | Italy | 37/103 |
| 853762 | 11/1960 | United Kingdom | 414/690 |

*Primary Examiner*—Robert J. Spar
*Assistant Examiner*—P. McCoy Smith
*Attorney, Agent, or Firm*—Robert T. Gammons

[57] ABSTRACT

An excavator for use in tunneling operations wherein there is minimal head room, comprising a boom mounted to a mobile carriage for rectilinear movement in a horizontal plane and angular movement in a vertical plane. A rigid arm is pivotally mounted at one end to the distal end of the boom for angular movement relative thereto and a slide is supported by the arm for rectilinear movement thereon. The backhoe is fixed to the slide and there is linkage for manipulating the backhoe.

6 Claims, 3 Drawing Figures

EXCAVATOR

BACKGROUND OF THE INVENTION

In my pending application Ser. No. 798,983, filed Nov. 18, 1985, now U.S. Pat. No. 4,677,772, there is shown an excavator wherein a generally arcuate arm is pivotally supported at one end to a mobile carriage which has at its other end an excavator and structure for supporting it at said end. While the structure shown there is designed to increase the range of use and to minimize failure of the supporting beam, it cannot be used efficiently in tunnel operations due to lack of head room. While the Gradall Company builds an excavator wherein the excavator is supported by a boom which can be moved rectilinearly in a generally horizontal plane and so is adapted to be used in tunnel excavation, the backhoe is connected directly to the distal end of the boom and, hence, the structure lacks the range provided by the structure shown in the aforesaid pending application. It is the purpose of this invention to provide an excavator which will embody the advantages of construction of the excavator shown in the aforesaid pending application and the structure of the Gradall machine in such a way as to be uniquely adapted to tunnel ecxavation and, at the same time, to provide a much larger range of operation than can be achieved with the use of the Gradall excavator.

SUMMARY OF THE INVENTION

As herein illustrated, the excavator comprises a boom, means supporting the boom at its proximal end for angular movement in the vertical plane about a horizontal axis, a scoop, means mounting the scoop to the distal end of the boom comprising a support fixed to the distal end of the boom, a rigid arm pivotally connected at one end to the support, a slide mounted to the other end of the rigid arm for rectilinear movement thereon, a piston for effecting rectilinear movement of the slide relative to the arm, means pivotally mounting the scoop to the distal end of the slide, an inextensible link pivotally connected at one end to the arm and at its other end to the scoop and linkage including a hydraulic cylinder connected to the scoop and to the support operable to rotate the scoop relative to the distal end of the slide.

The invention will now be described with reference to the accompanying drawings, wherein.

Figure 1:
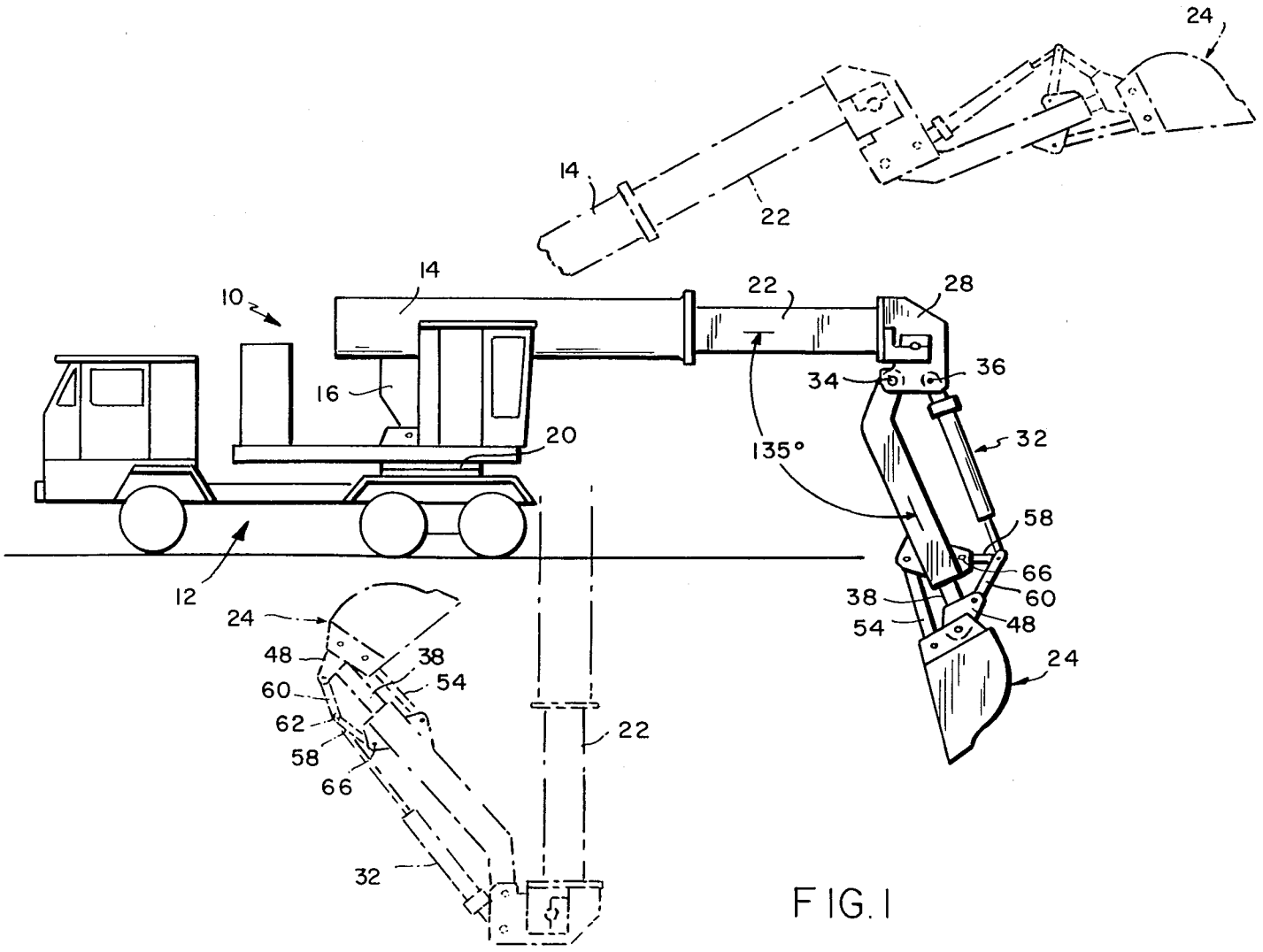
FIG. 1 is an elevation of the excavator constructed according to this invention provided with a backhoe showing the latter in various positions.

Referring to the drawings, FIG. 1, there is shown a mobile excavator 10 of the kind commonly known as a Gradall comprising a motorized chassis 12 on which is mounted a support 14 pivotally supported intermediate its opposite ends on a support 16 for angular movement about a horizontal axis. As illustrated in FIG. 1, the support 14 may be moved angularly from a horizontal position generally parallel to the surface on which the excavator rests upwardly to an angle of approximately 30° and downwardly to an angle substantially at right angles to its horizontal position. The support 14, in addition to being movable about a horizontal axis, is supported by a platform 20 on the chassis of the vehicle so as to be rotatable about a vertical axis. A boom 22 is telescopically mounted in the support 14 for rectilinear movement relative thereto and in accordance with this invention, means is attached to the distal end of the boom 22 for supporting a scoop 24 for movement relative to the boom. The aforesaid means comprises spaced, parallel bracket plates 28—28 bolted to the distal end of the boom 22 between which there are pivotally mounted one end of a rigid arm 30 and one end of a piston and cylinder assembly 32. The arm 30 is pivotally connected to the bracket plates 28—28 at 34 and the cylinder 32 is pivotally connected to the bracket plates 28—28 at 36. The pivots 34 and 36 provide horizontal axes about which the arm 30 and the piston 32 are free to swing.

Figure 2:
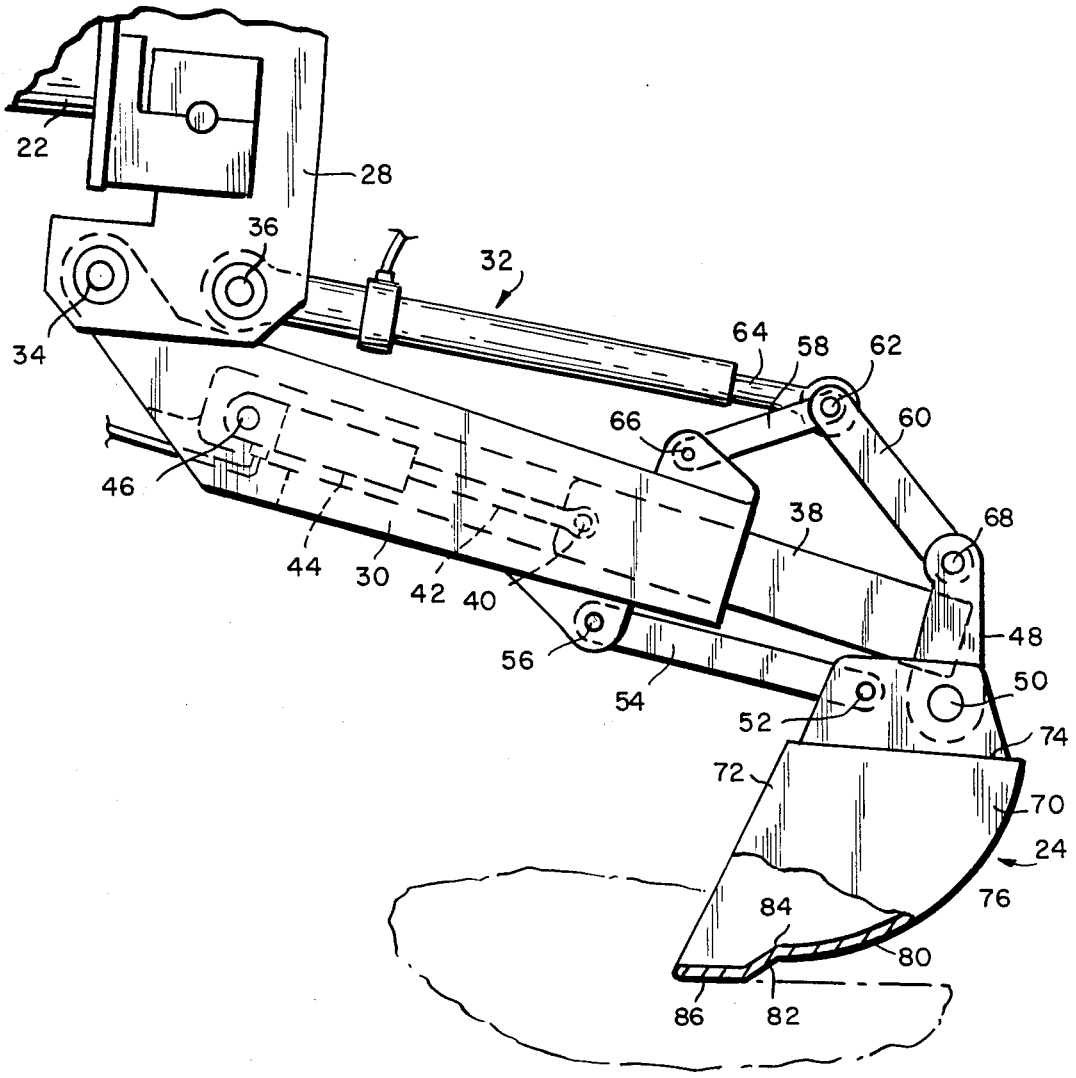
FIG. 2 is an enlarged elevation of the backhoe supporting structure by means of which it is mounted to the supporting beam.

The arm 30, FIG. 2, herein shown as of rectangular, transverse section, is hollow and contains within it a slide 38, a portion of which is located within the arm 30 and a portion of which extends from the arm 30. The inner end of the slide 38, FIG. 2, is pivotally connected at 40 to one end of a piston rod 42, the opposite end of which is connected to a cylinder 44 pivotally connected at 46 to the arm 30. The distal end of the slide 38 has mounted to it a pair of spaced, parallel bracket plates 48—48 which are rigidly secured thereto. The scoop 24 is provided with spaced, parallel hinge plates 49—49 which are pivotally connected by a pin 50 to the lower ends of the bracket plates 48—48 for pivotal movement about a horizontal axis at right angles to the axis of the slide. The hinge plates 49—49 of the scoop 24 are also pivotally connected by pin 52 to one end of rigid, inextensible links 54—54, the opposite ends of which are pivotally connected at 56 to the arm 30.

The upper ends of the bracket plates 48—48 are connected to the piston and cylinder assembly by pairs of links 58 and 60 pivotally connected at their proximal ends by a pin 62 to each other and to the distal end of the piston rod 64 of the piston and cylinder assembly and at their distal ends, respectively, by pivot means 66 and 68 to the arm 30 and to the bracket plates 48—48.

As thus structured, the scoop can be moved from the position shown in FIG. 1 above the horizontal to a position vertically below the horizontal and the scoop can be moved through an angle relative to the arm 30 through approximately 90°.

Figure 3:
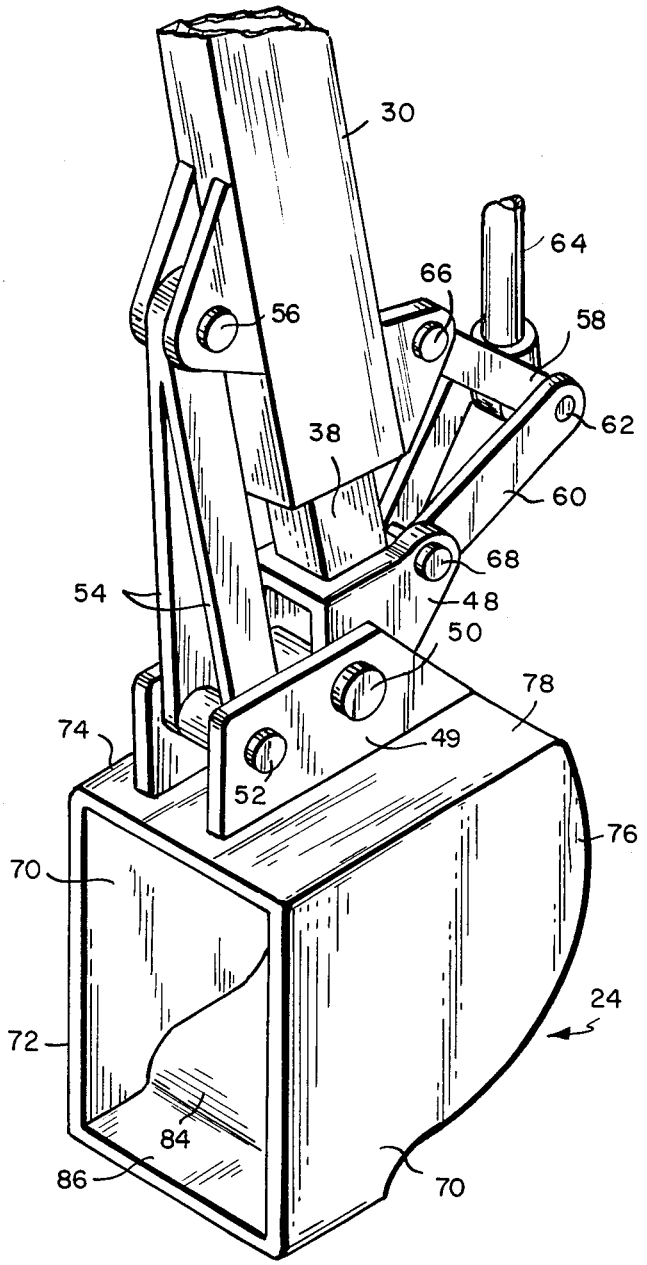
FIG. 3 is an enlarged perspective of the backhoe and structure supporting the same at the distal end of the slide.

In accordance with an important aspect of the invention, the scoop, as shown in FIGS. 2 and 3, comprises spaced, parallel check plates 70—70 having angularly-disposed rectilinear edges 72 and 74 and generally arcuate edges 76—76. A top plate 78 is welded to the edges 74—74 and a bottom plate 80 is welded to the edges 76—76. In accordance with an important aspect of the invention, the bottom plate 80 is provided with a re-entrant deviation 82, FIG. 2, which defines a transversely-extending stiffening rib 84 extending from check plate to check plate and a protruding lip 86. The configuration is such that when the backhoe is lowered into engagement with the surface to be excavated, the protrusion 86 engages the surface and, in so doing, holds the bottom plate 80 out of contact, thus substantially reducing wear of the back side of the hoe and the re-entrant groove 82 forming the rib 84 substantially stiffens the lip 86, reinforcing it so as to withstand distortion.

The excavator as thus described is designed to enable operation in tunnels where there is very little overhead room and to extend the range of its use both with respect to the horizontal reach of the backhoe and the vertical depth and, further, to provide the backhoe with a cutting edge which will withstand severe stress.

It should be understood that the present disclosure is for the purpose of illustration only and includes all modifications or improvements which fall within the scope of the appended claims.

What is claimed is:

1. An excavator comprising a boom, first means supporting the boom at its proximal end for angular movement in a vertical plane about a horizontal axis, a scoop, second means mounting the scoop to the distal end of the boom, comprising a rigid arm pivotally connected at its proximal end to the second means, a slide mounted to the rigid arm for rectilinear movement thereon, a piston for effecting rectilinear movement of the slide relative to the arm, means pivotally mounting the scoop to the distal end of the slide, an inextensible link pivotally connected at one end to the arm and at its other end to the scoop and linkage including a hydraulic cylinder connected to the distal end of the slide and to the second means operable to rotate the scoop relative to the distal end of the boom.

2. An excavator according to claim 1 wherein the linkage comprises a pair of links pivotally connected at one end to each other and at their other ends to, respectively, the arm and the slide and wherein the hydraulic cylinder is pivotally connected at one end to the second means and at its other end to the ends of the links connected to each other.

3. An excavator according to claim 1 wherein said rigid arm is angularly movable from a position wherein its axis is substantially parallel to the axis of the boom to a position disposed at an obtuse angle of approximately 135° to the axis of the boom.

4. An excavator according to claim 1 wherein the boom is supported for movement angularly from a horizontal position with respect to the surface on which the apparatus rests to a downwardly-extending, substantially perpendicular position.

5. An excavator according to claim 1 wherein the boom is rectilinearly movable on its support to extend it axially relative to its support.

6. An excavator comprising a boom, first support means supporting the boom at its proximal end for pivotal movement in a vertical plane about a horizontal axis, a scoop, and means mounting the scoop to the distal end of the boom, comprising second support means fixed to the distal end of the boom, a rigid arm pivotally connected at one end to said second support means for pivotal movement about an axis disposed at right angles to the axis of the boom and below the axis of the boom, a slide mounted to said rigid arm for rectilinear movement thereon, a first piston and cylinder assembly mounted to the second support means for effecting rectilinear movement of the slide relative to said rigid arm, a bracket pivotally mounting the scoop to the distal end of the slide for rotation about an axis disposed at right angles to the axis of the slide and below the axis of the slide, an inextensible link situated below the axis of the slide pivotally connected at one end to the arm and at its other end to the scoop, and linkage disposed above the arm connecting a second piston and cylinder assembly pivotally attached to said second support means, to said arm and slide, operable to rotate the scoop relative to the distal end of the boom, comprising a pair of links pivotally connected at their proximal ends to each other and to the second piston and cylinder assembly and at their distal ends to the arm and scoop.

* * * * *